United States Patent [19]

Maijala

[11] Patent Number: 4,761,858

[45] Date of Patent: Aug. 9, 1988

[54] PROCEDURE AND APPARATUS FOR CONTROLLING THE SURFACE MASS DISTRIBUTION OF PAPER WEB

[75] Inventor: Ari Maijala, Tampere, Finland

[73] Assignee: Yhtyneet Paperitehtaat Oy Jylhavaara, Valkaekoski, Finland

[21] Appl. No.: 886,267

[22] Filed: Jul. 16, 1986

[30] Foreign Application Priority Data

Aug. 8, 1985 [FI] Finland ..... 853042

[51] Int. Cl.[4] ..... B29C 13/00; D21H 5/26

[52] U.S. Cl. ..... 19/296; 19/304

[58] Field of Search ..... 19/304, 296, 300, 304, 19/307, 308, 266; 425/80.1, 83.1

[56] References Cited

U.S. PATENT DOCUMENTS 2,698,271 12/1954 Clark ..... 19/304 X
2,715,755 8/1955 Jones ..... 19/304 X
2,940,133 6/1960 Heritage ..... 425/83.1 X
4,003,105 1/1977 Guschin et al. ..... 425/80.1
4,025,254 5/1977 Arnold ..... 425/83.1 X
4,258,455 3/1981 Werner ..... 19/308 X

FOREIGN PATENT DOCUMENTS 0220466 8/1961 Austria ..... 425/83.1

*Primary Examiner*—Louis K. Rimrodt
*Attorney, Agent, or Firm*—Browdy and Neimark

[57] ABSTRACT

A procedure for controlling the surface mass distribution of a paper web being formed on a dry paper machine, wherein the suction air recirculated to the former is utilized. In procedures of prior art, the surface mass distribution has not been uniform enough. With the aid of the present invention the problem has been solved in that the quantity of air blown to the former is adjusted in the cross-machine direction in order to obtain the desired surface mass distribution.

17 Claims, 1 Drawing Sheet

PROCEDURE AND APPARATUS FOR CONTROLLING THE SURFACE MASS DISTRIBUTION OF PAPER WEB

BACKGROUND OF THE INVENTION

The present invention concerns a procedure and apparatus for controlling the surface mass distribution of a paper web formed on a dry paper machine, the procedure being utilizing the suction air recirculated to the former.

In prior art devices, former comprises rotating drums into which a fiber flow is introduced crosswise through the ends of the drums. Under the former is disposed a moving wire, through which air is drawn, whereby the particle-laden air forms a material web on the wire. The mantles of the drums are provided with exit holes through which fibers are spread onto the material web, but owing to the mode of distribution, no uniform distribution of the fiber flow from the exit holes of the drums is achieved: the profile presents errors up to 10%. In the present invention, the air recirculation principle disclosed in Finnish application of Bothas, Ser. No. 853043, assigned to Yhtyneet Paperitehtaat Oy Jylhavaara, filed Aug. 8, 1985, parallel to the application in hand, is utilized. In that connection, the air which is drawn into the suction box is returned to the upper part of the former as uniformly as possible.

OBJECT OF THE INVENTION

The object of the present invention is to provide a procedure and apparatus by which, utilizing the recirculated air just mentioned, the surface mass profile of the paper web is controlled. The procedure of the invention is therefore characterized in that the quantity of air blown to the former is controlled in the cross-machine direction for the purpose of obtaining the desired surface mass distribution.

An advantageous embodiment of the procedure of the invention is characterized in that the blow air coming to the former is conducted to pass through between ribs of which the spacing is adjustable.

The apparatus in which the procedure of the invention is applied is characterized in that the quantity of air blown to the former is adjustable in the cross-machine direction for the purpose of obtaining a surface mass distribution as desired.

An advantageous emobiment of the apparatus of the invention is characterized in that the ribs have been disposed in two planes, those ribs which are first in the direction of blowing being arranged to parallel the web that is being formed and the ribs in the second plane, at right angles to them.

Another advantageous embodiment of the apparatus of the invention is characterized in that the spacing of the longitudinal ribs is approximately 10 mm and that of the transversal ribs, approximately 0–15 mm.

Thanks to air recirculation, only about ¼ of the air that is drawn through the wire has to be brought from the outside. It is thus understood that the air which is blown in plays a major role. It is well-known, on the other hand, that the effect of blowing compared with suction, the velocity being the same, covers a distance larger by a factor of about 30. The higher velocity, and air quantity, through the drum and through its ambience onto the wire also carries with it a larger quantity of fibers, which are deposited on the wire.

BRIEF DESCRIPTION OF THE DRAWINGS

In the following, the invention is described in detail with reference to the attached drawings, wherein.

DETAILED DESCRIPTION OF A PREFERRED EMBODIMENT

Figure 1:
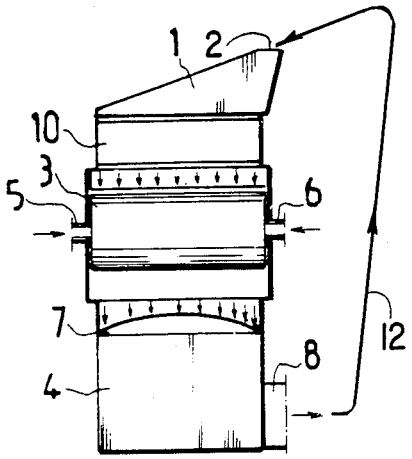
FIG. 1 presents, schematically and viewed in the direction in which the web travels, a system fitted with air recirculation.
Figure 2:
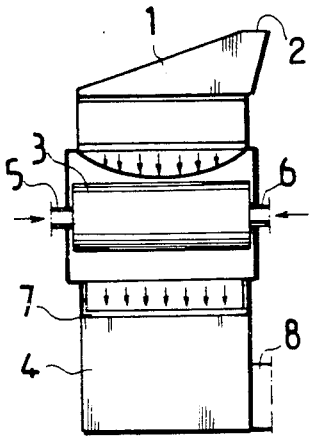
FIG. 2 shows the same as FIG. 1, but illustrating conditions after profile control has been applied.
Figure 3:
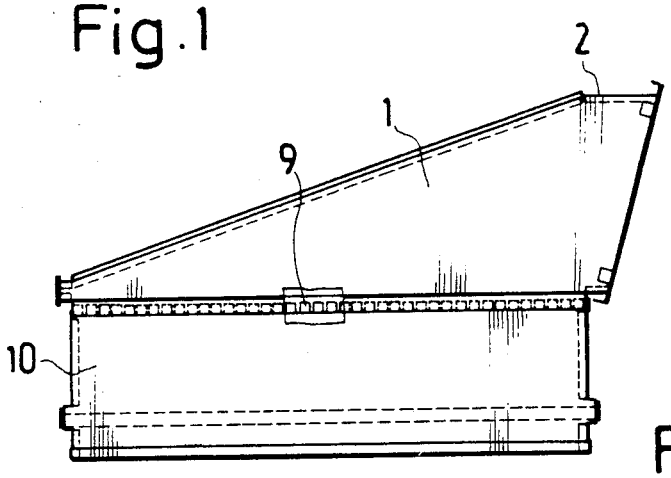
FIG. 3 displays, enlarged and partly sectioned, an advantageous embodiment of the invention, for controlling the profile.
Figure 4:
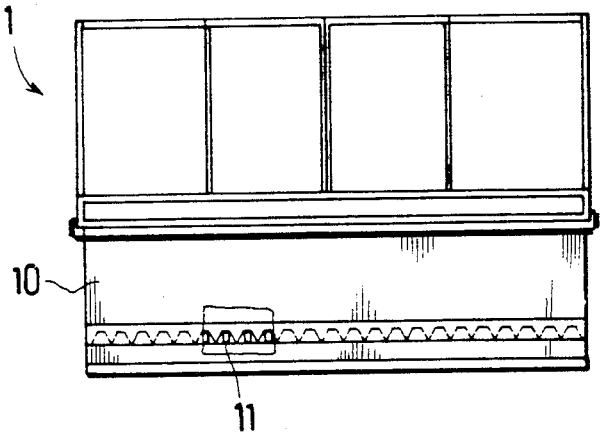
FIG. 4 presents, partly opened and sectioned, the means of FIG. 3 in elevational view.

In FIG. 1 is depicted part of a dry paper machine provided with drum former 3. On this machine, the paper web is formed on the wire 7, through which air is drawn into the suction box 4. The system has been provided with air recirculation, which however has not been depicted in greater detail in the figures. From the suction box 4, the air is blown through a tube 8 and through a system of passages shown schematically as 12, back to the upper part 1 of the former, through the aperture 2. The drum former 3 is supplied with a fiber flow through the supply apertures 5 and 6. The mantle of the former is provided with exit holes (not visible in the figures), through which fiber material enters the air flow that is being drawn through the wire 7, whereby the fibres remain on the wire and constitute a material web.

The recirculated air blown into the tapering passage 1 through the aperture 2 passes through between the ribs 9 disposed below the passage 1 and into an intermediate chamber 10. The ribs 9 have been arranged to run parallel with the direction of travel of the material web, and their spacing is adjustable. To greatest advantage, the spacing is approximately 10 mm. In this embodiment example, a second set of ribs 11 has been provided in the lower part of the intermediate chamber, these ribs being perpendicular to the ribs 9. The spacing of these ribs is likewise adjustable.

It is obvious to a person skilled in the art that the invention is not confined to the embodiment example presented in the foregoing and that is may rather be varied within the scope of the claims following below.

What is claimed is:

1. Apparatus for controlling the surface mass distribution of a paper web formed on a top surface of a wire of a dry paper machine, said apparatus comprising a suction box under said wire;

a rotatable drum former above said wire, said drum former having supply means including at least one passage for flowing fiber thereto, said drum former also having exit holes through which said supplied fiber may be drawn onto said top surface of said wire;

blowing means, distinct from said supply means, above said drum former for blowing air through said drum former and onto said top surface of said wire in a direction essentially perpendicular to said top surface of said wire; and a first set of ribs above said drum former for directing air from said blowing means to said drum former, said ribs being arranged along a first plane essentially parallel to said top surface of said wire and substantially over the width of said wire, said ribs of said first set of ribs extending longitudinally with respect to said wire, the spacing between said ribs of said first set of ribs being adjustable within said first plane.

2. The apparatus of claim 1, further comprising a second set of ribs, arranged in a second plane essentially parallel to that of said first set of ribs, and substantially over the width of said wire, positioned between said first set of ribs and said drum former, said ribs of said second set of ribs extending at right angles to said ribs of said first set of ribs, the spacing between said ribs of said second set of ribs being adjustable within said second plane.

3. The apparatus of claim 2, wherein said ribs of said first set of ribs are spaced about 10 mm apart from each other.

4. The apparatus of claim 3, wherein said blowing means receives air drawn through said wire by said suction box.

5. The apparatus of claim 2, wherein said ribs of said second set of ribs are spaced about 1–15 mm apart from each other.

6. The apparatus of claim 5, wherein said ribs of said first set of ribs are spaced about 10 mm apart from each other.

7. The apparatus of claim 6, wherein said blowing means receives air drawn through said wire by said suction box.

8. The apparatus of claim 5, wherein said blowing means receives air drawn through said wire by said suction box.

9. The apparatus of claim 2, wherein said blowing means receives air drawn through said wire by said suction box.

10. The apparatus of claim 1, wherein said blowing means receives air drawn through said wire by said suction box.

11. The apparatus of claim 10, wherein said supply passage enters said drum former through an end side of said drum former.

12. The apparatus of claim 1, wherein said supply passage enters said drum former through an end side of said drum former.

13. A process for controlling the surface mass distribution of a paper web formed on a wire positioned below a drum former of a dry paper machine, comprising the steps of:

supplying fiber into said drum former through a passage provided therein, said drum former also including exit holes through which said supplied fiber may be drawn onto said wire;

rotating said drum former;

drawing said supplied fibers through said exit holes by means of a suction box below said wire to form a paper web on a top surface of said wire while controlling the surface mass distribution of said paper web thus formed by blowing air, from a blowing means, distinct from said supply means, above said drum former through a first set of ribs arranged and adjustably spaced within a first plane parallel to said top surface, positioned between said blowing means and said drum former, onto said top surface of said wire, in a direction essentially perpendicular to said top surface of said wire, said ribs of said first set of ribs extending longitudinally with respect to said wire; and adjusting the spacing within said first plane between said ribs.

14. The process of claim 13, wherein air drawn into said suction box is then passed to said blowing means and blown onto said top surface of said wire in a direction essentially perpendicular to said top surface of said wire.

15. The process of claim 14, wherein said fiber is supplied through said passage and into said drum former through a side end of said drum former.

16. The process of claim 13, wherein said fiber is supplied through said passage and into said drum former through a side end of said drum former.

17. The process of claim 13, wherein air from said blowing means passes through a second set of ribs, arranged and adjustably spaced within a second plane parallel to said top surface of said wire, between said first set of ribs and said drum former, said ribs of said second set of ribs extending at right angles with respect to said ribs of said first set of ribs.

* * * * *